US009599918B2

(12) United States Patent
Morales-Tirado et al.

(10) Patent No.: US 9,599,918 B2
(45) Date of Patent: Mar. 21, 2017

(54) CLEAR TONER COMPOSITIONS

(71) Applicant: XEROX CORPORATION, Norwalk, CT (US)

(72) Inventors: Juan A. Morales-Tirado, Henrietta, NY (US); John James Ianni, Medina, NY (US); Moritz P. Wagner, Rochester, NY (US)

(73) Assignee: XEROX CORPORATION, Norwalk, CT (US)

( * ) Notice: Subject to any disclaimer, the term of this patent is extended or adjusted under 35 U.S.C. 154(b) by 8 days.

(21) Appl. No.: 14/682,948

(22) Filed: Apr. 9, 2015

(65) Prior Publication Data

US 2016/0299448 A1 Oct. 13, 2016

(51) Int. Cl.

| | |
|---|---|
| ***G03G 9/00*** | (2006.01) |
| ***G03G 9/087*** | (2006.01) |
| ***G03G 9/08*** | (2006.01) |
| ***G03G 9/097*** | (2006.01) |

(52) U.S. Cl.

CPC ..... *G03G 9/08706* (2013.01); *G03G 9/0819* (2013.01); *G03G 9/09708* (2013.01); *G03G 9/09725* (2013.01)

(58) Field of Classification Search

CPC ..... G03G 9/08706; G03G 9/0819; G03G 9/08708; G03G 9/09725

USPC ..... 430/109.4, 108.3, 109.1, 123.52

See application file for complete search history.

(56) References Cited

U.S. PATENT DOCUMENTS

| | | | |
|---|---|---|---|
| 5,716,751 | A | 2/1998 | Bertrand et al. |
| 6,063,827 | A | 5/2000 | Sacripante et al. |
| 6,087,059 | A | 7/2000 | Duggan et al. |
| 6,326,119 | B1 | 12/2001 | Hollenbaugh et al. |
| 6,359,105 | B1 | 3/2002 | Ianni et al. |
| 6,593,049 | B1 | 7/2003 | Veregin et al. |
| 6,756,176 | B2 | 6/2004 | Stegamat et al. |
| 6,830,860 | B2 | 12/2004 | Sacripante et al. |
| 2006/0222991 | A1 | 10/2006 | Sacripante et al. |
| 2008/0182193 | A1* | 7/2008 | Agur ..... G03G 9/08755 430/109.4 |
| 2014/0315123 | A1 | 10/2014 | Kmiecik-Lawrynowicz et al. |

* cited by examiner

*Primary Examiner* — Thorl Chea

(74) *Attorney, Agent, or Firm* — Pillsbury Winthrop Shaw Pittman LLP

(57) ABSTRACT

Clear toner compositions for use in offset lithography (or offset printing). Such clear toner compositions comprising a toner particle comprising a polyester resin, a highly cross-linked resin, a surface additive applied to a surface of the toner particle, which exhibit desirable properties, including for example, having low haze level.

20 Claims, 1 Drawing Sheet

CLEAR TONER COMPOSITIONS

BACKGROUND

The present embodiments relate to clear toner compositions. More particularly, these embodiments relate to clear toners for use in offset lithography (or offset printing).

In the offset process, the image may be indirectly applied to the media, such as paper or other materials, through an intermediate transfer, or blanket cylinder, whereby the image from the plate is applied first to a blanket cylinder, which then offsets, or transfers, from the blanket cylinder to the media.

In order to compete effectively with offset printing, or for high quality color applications or for special effects, lithographic printers often add a fifth xerographic station to enable gamut extension via the addition of a fifth color. At any given time, the lithographic printing machine runs CMYK toners plus a fifth color in the fifth station, depending on the color space where the gamut extension is desired. A fifth color is any spot color or clear ink used in addition to the four color CMYK mix (Cyan, Magenta, Yellow and Black).

To increase the capability of the system, there is a need to develop a clear toner to run in the fifth xerographic station, which is used to enhance the gloss of the impression or highlight specific areas on the print (also known as spot varnish). This is a highly attractive offering in systems targeting the Graphic Arts market. By loading the clear toner in the fifth station, the end users will have the capability of using this feature on demand to enhance the desired output.

Accordingly, there is a need for clear toners that exhibit high gloss and low haze.

SUMMARY

The present disclosure provide a toner composition comprising a toner particle comprising a polyester resin, a highly crosslinked resin, a surface additive applied to a surface of the toner particle; wherein the toner has a % haze of from about 1% to about 15%.

In certain embodiments, the disclosure provide a toner composition comprising a toner particle comprising a polyester resin, a crosslinked resin, wherein the weight ratio of the polyester resin to the highly crosslinked resin is from about 90%:10% to about 80%:20%, a surface additive applied to a surface of the toner particle, wherein the surface additive comprises a negative charging silica, a positive charging silica and a metal oxide, further wherein the toner has a % haze of from about 1% to about 15%.

In certain embodiments, the disclosure provides a toner composition comprising: a toner particle comprising a polyester resin; a crosslinked resin, wherein the weight ratio of the polyester resin to the crosslinked resin is from about 90%:10% to about 80%:20%; a surface additive applied to a surface of the toner particle, wherein the surface additive comprises a negative charging silica, a positive charging silica and titanium dioxide; wherein the toner has a % haze of from about 1% to about 15%, further wherein the toner exhibits an Elastic Modulus of from about 1680 dyn/cm$^2$ to about 2300 dyn/cm$^2$, and a Viscous Modulus of from about 250 dyn/cm$^2$ to about 385 dyn/cm$^2$.

BRIEF DESCRIPTION OF DRAWINGS

Various embodiments of the present disclosure will be described herein below with reference to the figures wherein.

DETAILED DESCRIPTION

Figure 1:
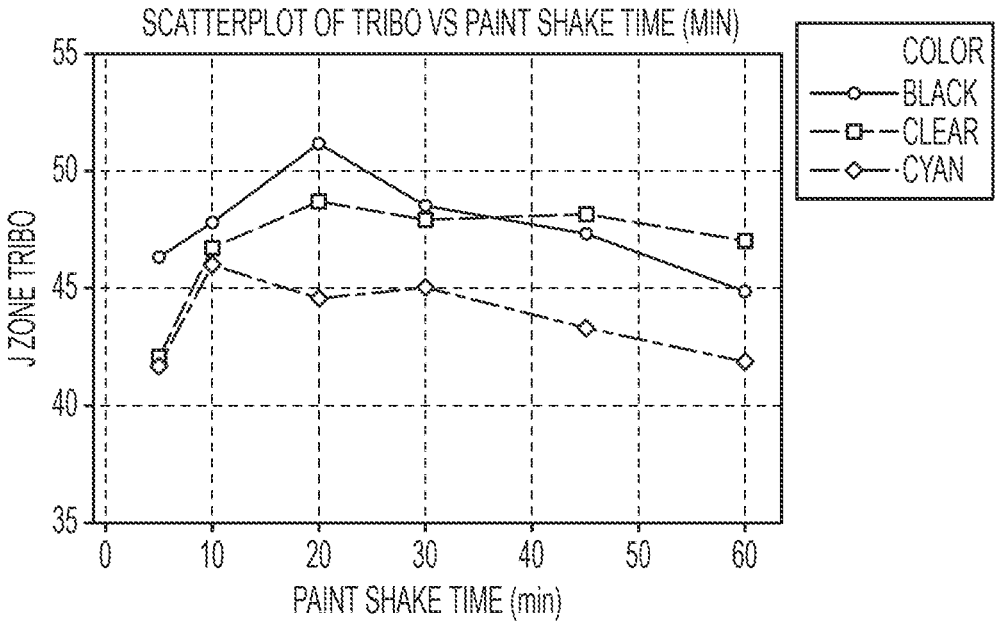
FIG. 1 is a graph showing measured J-zone triboelectric charge for a clear toner according to an embodiment of the present disclosure and two control color toners.

The present embodiments provide a clear toner having a low percent haze level of no more than 15%. As used herein, haze generally refers to a cloudy appearance caused by scattered of light upon passing through a film or sheet of a material. Light may be scattered by particles contained within the film, such as pigments or contaminants, surface imperfections, or fine texture. In the case of clear toners, incompatibility between ingredients leading to the formation of domains can also lead to a cloudy or hazy appearance. Generally, haze is measured from the scattering of light off a clear surface. The higher the percent haze, the less transparent the toner is. The haze for a film may be measured with a spectrophotometer or haze meter using ASTM method D1003-95. The haze meter uses a pivoting light source with a single collimated beam of light. The light passes through the sample and enters one side of the sphere and is directed to an exit port on the opposite side of the sphere. When the light source is in the first position, the light leaves the exit port and it is absorbed by a light trap. When the light source is pivoted, the beam of light is directed towards the sphere wall and diffused. A detector in the sphere is filtered to Illuminant C and the % of light scattered at a 2 degree angle is calculated. The % haze is calculated using the expression % Haze=100%*($T_{dif}$)/($T_T$) where $T_{dif}$ is the percent of diffuse light that scatters at 2 degrees or higher and $T_T$ is the percent of total light transmitted through the sample. In one or more embodiments, the haze value of the film is less than 25%. In other embodiments, the haze is from about 1% to about 15%, from about 6.5% to about 15%, from about 4.5% to about 10% from about 4.5% to about 6.5%. The transparency of the toner can also be assessed visually by placing the transparent substrate with the clear toner layer on a black background.

The toner of the present embodiments has a gloss value of from about 70 to about 90 ggu, from about 72 to about 88 ggu, or from about 75 to about 85 ggu.

The gloss from a toner on a substrate is a function of the viscoelasticity of the toner particle. Viscoelastic properties that influence the final gloss product are typically described by the property ratio tan δ. Tan δ is a ratio of the storage modulus G' (elastic modulus) and the loss modulus G" (viscous modulus). The elastic modulus is related to the elasticity of a toner and the viscous modulus is related to the plasticity of a toner. To maintain sufficient gloss of a fixed image, it is important to adjust a ratio of elasticity to plasticity while maintaining a desired elasticity. The toner of the present embodiments exhibit an Elastic Modulus of from about 1680 dyn/cm$^2$ to about 2520 dyn/cm$^2$, from about 1890 dyn/cm$^2$ to about 2300 dyn/cm$^2$, or about 2100 dyn/cm$^2$. The toner of the present embodiments exhibit an Viscous Modulus of from about 250 dyn/cm$^2$ to about 385 dyn/cm$^2$, from about 290 dyn/cm$^2$ to about 350 dyn/cm$^2$, or about 320 dyn/cm$^2$. Both the Viscous and Elastic Modulus are measured at 140° C. at a frequency of 40 rad/sec.

The clear toner composition of the present embodiments includes a polyester resin and a highly crosslinked polyester resin. For example, the highly crosslinked polyester has a degree of crosslinking of from about 19% to about 49%, from about 25% to about 40%, or from about 30% to about 35%. The polyester resin may be crystalline, amorphous or combination thereof. The present inventors discovered that the weight ratio of the polyester resin to the highly crosslinked resin plays an important role not only for the gloss level of the toner, but also for the haze. To achieve the high gloss property and low haze, the weight ratio of the polyester resin to the highly crosslinked resin should be kept in the range of from about 90%:10% to about 80%:20%, from about 8%:20% to about 85%:15%, from about 88%:12% to about 92%:8%.

Resins

Suitable polyester resins include, for example, crystalline, amorphous, combinations thereof, and the like. The polyester resins may be linear, branched, combinations thereof, and the like. Polyester resins may include, in embodiments, those resins described in U.S. Pat. Nos. 6,593,049 and 6,756,176, the disclosure of each of which hereby is incorporated by reference in entirety. Suitable resins include a mixture of an amorphous polyester resin and a crystalline polyester resin as described in U.S. Pat. No. 6,830,860, the disclosure of which is hereby incorporated by reference in entirety.

Crystalline Resins

In embodiments, the crystalline resin may be a polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixtures thereof, and the like. The aliphatic diol may be, for example, selected in an amount of from about 40 to about 60 mole % (although amounts outside of those ranges may be used).

Examples of organic diacids or diesters including vinyl diacids or vinyl diesters selected for the preparation of the crystalline resins include oxalic acid, succinic acid, glutaric acid, adipic acid, suberic acid, azelaic acid, sebacic acid, fumaric acid, dimethyl fumarate, dimethyl itaconate, cis-1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid, mesaconic acid, and a diester or anhydride thereof. The organic diacid may be selected in an amount of, for example, in embodiments from about 40 to about 60 mole %.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate) and so on. Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinimide), and poly(propylene-sebecamide). Examples of polyimides include poly(ethylene-adipimide), poly(propylene-adipimide), poly(butylene-adipimide), poly(pentylene-adipimide), poly(hexylene-adipimide), poly(octylene-adipimide), poly(ethylene-succinimide), poly(propylene-succinimide), and poly(butylene-succinimide).

Suitable crystalline resins include those disclosed in U.S. Publ. No. 2006/0222991, the disclosure of which is hereby incorporated by reference in entirety. In embodiments, a suitable crystalline resin may be composed of ethylene glycol and a mixture of dodecanedioic acid and fumaric acid comonomers.

The crystalline resin may possess various melting points of, for example, from about 30° C. to about 120° C., in embodiments, from about 50° C. to about 90° C. The crystalline resin may have a number average molecular weight (Mn) as measured by gel permeation chromatography (GPC) of, for example, from about 1,000 to about 50,000, in embodiments, from about 2,000 to about 25,000, and a weight average molecular weight (Mw) of, for example, from about 2,000 to about 100,000, in embodiments, from about 3,000 to about 80,000, as determined by GPC. The molecular weight distribution (Mw/Mn) of the crystalline resin may be, for example, from about 2 to about 6, in embodiments, from about 3 to about 4. The crystalline polyester resins may have an acid value of less than about 1 meq KOH/g, from about 0.5 to about 0.65 meq KOH/g, in embodiments, from about 0.65 to about 0.75 meq KOH/g, from about 0.75 to about 0.8 meq KOH/g.

Amorphous Resins

Examples of diacid or diesters selected for the preparation of amorphous polyesters include dicarboxylic acids or diesters selected from the group consisting of terephthalic acid, phthalic acid, isophthalic acid, fumaric acid, maleic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and mixtures thereof. The organic diacid or diester is selected, for example, from about 45 to about 52 mole % of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hyroxyethyl)-bisphenol A, bis(2-hyroxypropyl)-bisphenol A, 1,4-cyclohexanedimethanol, 1,3-cyclohexanedimethanol, xylenedimethanol, cyclohexanediol, diethylene glycol, bis(2-hydroxyethyl) oxide, dipropylene glycol, dibutylene, 1,2-ethanediol, 1,5-pentanediol, 1,6-hexanediol, 1,7-heptanediol, 1,8-octanediol, 1,9-nonanediol, 1,10-decanediol, 1,12-dodecanediol, and the like; alkali sulfo-aliphatic diols, such as, sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixtures thereof, and the like, and mixtures thereof. The amount of organic diol selected may vary, and more specifically, is, for example, from about 45 to about 52 mole % of the resin.

Alkali sulfonated difunctional monomer examples, wherein the alkali is lithium, sodium, or potassium, include dimethyl-5-sulfo-isophthalate, dialkyl-5-sulfo-isophthalate-4-sulfo-1,8-naphthalic anhydride, 4-sulfo-phthalic acid, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, dialkyl-sulfo-terephthalate, sulfo-ethanediol, 2-sulfo-propanediol, 2-sulfo-butanediol, 3-sulfo-pentanediol, 2-sulfo-hexanediol, 3-sulfo-2-methylpentanediol, N,N-bis(2-hydroxyethyl)-2-aminoethane sulfonate, 2-sulfo-3,3-dimethylpent-anediol, sulfo-p-hydroxybenzoic acid, mixtures thereto, and the like. Effective difunctional monomer amounts of, for example, from about 0.1 to about 2 wt % of the resin may be selected.

Exemplary amorphous polyester resins include, but are not limited to, propoxylated bisphenol A fumarate resin, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly (propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), a copoly(propoxylated bisphenol A co-fumarate)-copoly (propoxylated bisphenol A co-terephthalate), a terpoly (propoxylated bisphenol A co-fumarate)-terpoly(propoxylated bisphenol A co-terephthalate)-terpoly-(propoxylated bisphenol A co-dodecylsuccinate), and combinations thereof.

In embodiments, a suitable amorphous polyester resin may be a poly(propoxylated bisphenol A co-fumarate) resin. Examples of such resins and processes for their production include those disclosed in U.S. Pat. No. 6,063,827, the disclosure of which is hereby incorporated by reference in entirety.

An example of a linear propoxylated bisphenol A fumarate resin which may be utilized as a latex resin is available under the trade name SPARII from Resana S/A Industrias Quimicas, Sao Paulo Brazil. Other propoxylated bisphenol A polyester based resins that may be utilized and are commercially available include XP767, FXC-42 and FXC-56 from Kao Corporation, Japan, and XP777 from Reichhold, Research Triangle Park, N.C., and the like.

In embodiments, a suitable amorphous resin utilized in a toner of the present disclosure may be a low molecular weight amorphous resin, sometimes referred to, in embodiments, as an oligomer, having an Mw of from about 500 daltons to about 10,000 daltons, in embodiments, from about 1000 daltons to about 5000 daltons, in embodiments, from about 1500 daltons to about 4000 daltons. The amorphous resin may possess a Tg of from about 58.5° C. to about 66° C., in embodiments, from about 60° C. to about 62° C. The low molecular weight amorphous resin may possess a softening point of from about 105° C. to about 118° C., in embodiments, from about 107° C. to about 109° C. The amorphous polyester resins may have an acid value of from about 8 to about 20 meq KOH/g, in embodiments, from about 10 to about 16 meq KOH/g, in embodiments, from about 11 to about 15 meq KOH/g.

In other embodiments, an amorphous resin utilized in forming a toner of the present disclosure may be a high molecular weight amorphous resin. As used herein, the high molecular weight amorphous polyester resin may have, for example, an Mn, as measured by GPC of, for example, from about 1,000 to about 10,000, in embodiments, from about 2,000 to about 9,000, in embodiments, from about 3,000 to about 8,000, in embodiments from about 6,000 to about 7,000. The Mw of the resin can be greater than 45,000, for example, from about 45,000 to about 150,000, in embodiments, from about 50,000 to about 100,000, in embodiments, from about 63,000 to about 94,000, in embodiments, from about 68,000 to about 85,000, as determined by GPC. The polydispersity index (PD), equivalent to the molecular weight distribution, is above about 4, such as, for example, in embodiments, from about 4 to about 20, in embodiments, from about 5 to about 10, in embodiments, from about 6 to about 8, as measured by GPC. The high molecular weight amorphous polyester resins, which are available from a number of sources, may possess various melting points of, for example, from about 30° C. to about 140° C., in embodiments, from about 75° C. to about 130° C., in embodiments, from about 100° C. to about 125° C., in embodiments, from about 115° C. to about 124° C. High molecular weight amorphous resins may possess a Tg of from about 53° C. to about 58° C., in embodiments, from about 54.5° C. to about 57° C.

In further embodiments, the combined amorphous resins may have a melt viscosity of from about 10 to about 1,000,000 Pa*S at about 130° C., in embodiments, from about 50 to about 100,000 Pa*S.

Catalyst

Polycondensation catalysts which may be utilized in forming either the crystalline or amorphous polyesters include tetraalkyl titanates, dialkyltin oxides, such as, dibutyltin oxide, tetraalkyltins, such as, dibutyltin dilaurate, and dialkyltin oxide hydroxides, such as, butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole % to about 5 mole %, based on the starting diacid or diester used to generate the polyester resin.

Crosslinking Resin

Linear or branched unsaturated polyesters can be converted into a highly crosslinked polyester by reactive extrusion. Linear or branched unsaturated polyesters may include both saturated and unsaturated diacids (or anhydrides) and dihydric alcohols (glycols or diols). The resulting unsaturated polyesters can be reactive (for example, crosslinkable) on two fronts: (i) unsaturation sites (double bonds) along the polyester chain, and (ii) functional groups, such as, carboxyl, hydroxy and similar groups amenable to acid-base reaction. Unsaturated polyester resins may be prepared by melt polycondensation or other polymerization processes using diacids and/or anhydrides and diols. Illustrative examples of unsaturated polyesters may include any of various polyesters, such as SPAR™ (Dixie Chemicals), BECKOSOL™ (Reichhold Inc), ARAKOTE™ (Ciba-Geigy Corporation), HETRON™ (Ashland Chemical), PARAPLEX™ (Rohm & Hass), POLYLITE™ (Reichhold Inc), PLASTHALL™ (Rohm & Hass), CYGAL™ (American Cyanamide), ARMCO™ (Armco Composites), ARPOL™ (Ashland Chemical), CELANEX™ (Celanese Eng), RYNITE™ (DuPont), STYPOL™ (Freeman Chemical Corporation), a linear unsaturated poly(propoxylated bisphenol A co-fumarate) polyester, XP777 (Reichhold Inc.), mixtures thereof and the like. The resins may also be functionalized, such as, carboxylated, sulfonated or the like, such as, sodio sulfonated.

The crosslinked resin may be prepared by (1) melting the linear or branched unsaturated polyester in a melt mixing device; (2) initiating cross-linking of the polymer melt, preferably with a chemical crosslinking initiator and increasing reaction temperature; (3) keeping the polymer melt in the melt mixing device for a sufficient residence time that partial cross-linking of the linear or branched resin may be achieved; (4) providing sufficiently high shear during the cross-linking reaction to keep the gel particles formed and broken down during shearing and mixing and well distributed in the polymer melt; (5) optionally devolatizing the polymer melt to remove any effluent volatiles; and (6) optionally adding additional linear or branched resin after the crosslinking in order to achieve the desired level of gel content in the end resin. As used herein, the term "gel" refers to the crosslinked domains within the polymer. Chemical initiators such as, for example, organic peroxides or azo-compounds may be used for making the crosslinked resin for the invention. In one embodiment, the initiator is 1,1-di(t-butyl peroxy)-3,3,5-trimethylcyclohexane.

In one embodiment, the highly crosslinked resin is prepared from an unsaturated poly(propoxylated bisphenol A co-fumarate) polyester resin.

Surface Additives

The toner composition of the present embodiments may include one or more surface additives. The surface additives are coated onto the surface of the toner particles, which may provide a total surface area coverage of from about 50% to about 99%, from about 60% to about 90%, or from about 70% to about 80% of the toner particle. The toner composition of the present embodiment may include from about 2.7% to about 4.0%, from about 3.0% to about 3.7%, or from about 3.1% to about 3.5 of surface additive based on the total weight on the toner.

The surface additives may include silica, titania and stearates. The charging and flow characteristics of a toner are influenced by the selection of surface additives and concentration of such in the toner. The concentration of surface additives and their size and shape control the arrangement of these on the toner particle surface. In embodiments, the silica includes two coated silicas. More specifically, one of the two silicas may be a negative charging silica, and the other silica may be a positive charging silica (relative to the carrier). By negatively charging is meant that the additive is negatively charging relative to the toner surface measured by determining the toner triboelectric charge with and without the additive. Similarly, by positively charging is meant that the additives are positively charging relative to the toner surface measured by determining the toner triboelectric charge with and without the additive.

An example of the negative charging silica include NA50HS obtained from DeGussa/Nippon Aerosil Corporation, which is a fumed silica coated with a mixture of hexamethyldisilazane and aminopropyltriethoxysilane (having approximately 30 nanometers of primary particle size and about 350 nanometers of aggregate size).

An example of the relatively positive charging silica include H2050 silica with polydimethylsiloxane units or segments, and having amino/ammonium functions chemically bonded onto the surface of highly hydrophobic fumed silica, and which coated silica possesses a BET surface area of about 110 to about ±20 $m_2/g$ (obtained from Wacker Chemie).

The negative charging silica may be present in an amount from about 1.6% to about 2.4%, from about 1.8% to about 2.2%, from about 1.9% to about 2.1%, by weight of the surface additives.

The positive charging silica may be present in an amount from about 0.08% to about 1.2%, from about 0.09% to about 0.11%, from about 0.09% to about 0.1%, by weight of the surface additives.

The ratio of the negatively charging silica to the positively charging silica ranges from, for example, about 13:1 to about 30:1, or from about 15:1 to about 25:1, weight basis.

The surface additives may also include a titania. The titania may be present in an amount from about 0.53% to about 0.9%, from about 0.68% to about 0.83%, from about 0.7% to about 0.8%, by weight of the surface additives. A suitable titania for use herein is, for example, SMT5103 available from Tayca Corp., a titania having a size of about 25 to about 55 nm treated with decylsilane.

The weight ratio of the negative charging silica to the titania is from about 1.8:1 to about 4.5:1, from about 2.2:1 to about 3.2:1, or from about 2.5:1 to about 3.0:1.

The surface additives may also include a lubricant and conductivity aid, for example a metal salt of a fatty acid such as, e.g., zinc stearate, calcium stearate. A suitable example includes Zinc Stearate L from Ferro Corp., or calcium stearate from Ferro Corp. Such a conductivity aid may be present in an amount from about 0.10% to about 1.00% by weight of the toner.

In another preferred embodiment, the toner and/or surface additive also includes a conductivity aid, for example a metal salt of a fatty acid such as, e.g., zinc stearate. A suitable example includes Zinc Stearate L from Ferro Corp. Such a conductivity aid may be present in an amount from about 0.10% to about 1.00% by weight of the toner.

The clear toner compositions of the present embodiments can be prepared by mixing, for example, melt mixing, and heating resin particles in a toner extrusion device, such as the ZSK25 available from Werner Pfleiderer, and removing the formed toner composition from the device. Subsequent to cooling, the toner composition is subjected to grinding utilizing, for example, a Sturtevant micronizer, reference U.S. Pat. No. 5,716,751, the disclosure of which is totally incorporated herein by reference. Subsequently, the toner compositions can be classified utilizing, for example, a Donaldson Model B classifier for the purpose of removing fines, that is, the particles are accompanied by very low levels of fine particles of the same material. For example, the levels of fine particles is in the range of from about 0.1% to about 3% by weight of the toner. After removing the excess fines content, the clear tone may have a mean particle size of from about 6 microns to about abut 8 microns, from about 6.5 microns to about abut 7.5 microns, or about 7.0 microns. The GSD refers to the upper geometric standard deviation (GSD) by volume (coarse level) for (D84/D50) and can be from about 1.10 to about 1.30, or from about 1.15 to about 1.25, or from about 1.18 to about 1.21. The geometric standard deviation (GSD) by number (fines level) for (D50/D16) can be from about 1.10 to about 1.30, or from about 1.15 to about 1.25, or from about 1.22 to about 1.24. The particle diameters at which a cumulative percentage of 50% of the total toner particles are attained are defined as volume D50, and the particle diameters at which a cumulative percentage of 84% are attained are defined as volume D84. These aforementioned volume average particle size distribution indexes GSDv can be expressed by using D50 and D84 in cumulative distribution, wherein the volume average particle size distribution index GSDv is expressed as (volume D84/volume D50). These aforementioned number average particle size distribution indexes GSDn can be expressed by using D50 and D16 in cumulative distribution, wherein the number average particle size distribution index GSDn is expressed as (number D50/number D16). The closer to 1.0 that the GSD value is, the less size dispersion there is among the particles. The aforementioned GSD value for the toner particles indicates that the toner particles are made to have a narrow particle size distribution. The particle diameters are determined by a Multisizer III.

Thereafter, the surface additive mixture and other additives are added by the blending thereof with the toner obtained. The term "particle size," as used herein, or the term "size" as employed herein in reference to the term "particles," means volume weighted diameter as measured by conventional diameter measuring devices, such as a Multisizer III, sold by Coulter, Inc. Mean volume weighted diameter is the sum of the mass of each particle times the diameter of a spherical particle of equal mass and density, divided by total particle mass.

The size distribution and additive formulation of the toner is such that it enables the toner to be operated in a system providing offset lithography at a very low mass target while still providing sufficient coverage of the substrate. In this context, the mass target refers to concentration of toner particles that are developed or laid on the substrate (i.e. paper or other) per unit area of substrate. The size distribution and additive formulation of the toner is such that it enables the system to operate at a mass target of 0.3 to 0.4 mg of toner per square centimeter of substrate. The rheology of the toner of the present embodiments is also designed to maximize the gloss and reduce the risk of toner offset to the fuser with the fuser roll used in the system.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

Example 1

Preparation of Clear Toner Particles in Accordance to Embodiments Herein

Example 1A

Preparation of Parent Particles

About 90% of a polyester resin XP777 (a propoxylated bisphenol A fumarate resin, Resapol from Reichold), and about 10% of a crosslinked resin A (which was prepared from a linear unsaturated poly(propoxylated bisphenol A co-fumarate) polyester resin XP777) were melt mixed and extruded in a ZSK-25 extruder. The crosslinked resin was prepared according to the method outlined in U.S. Pat. No. 6,359,105, incorporated here by reference in its entirety.

The resulting extrudate of linear and crosslinked resin was pulverized in a 200 AFG fluid bed jet mill. During the pulverization process, about 0.3% TS530 silica was added as a flow aid. The parent particle has a median particle size of about 6.4 microns, a mean size of about 7.0 μm after removing the excess fines contents, i.e., with percent fines less than 5 μm or no more than 15% by number as measured by a. Multisizer III The resulting size distribution parameters of the clear toner particles are as follows:

Volume Median Diameter—7.1 microns

Volume D84/D50—1.19

Number D50/D16—1.23

Number %<5 microns—13%

The clear particles were classified in a B18 Tandem Acucut system. The clear particle has an Elastic Modulus of around 2100 dyn/cm$^2$ and a Viscous Modulus of 320 dyn/cm$^2$. The Viscous and Elastic Modulus are measured at 140° C. at a frequency of 40 rad/sec.

Example 1B

Blending of Surface Additives to Parent Particles

The parent particles obtained above were blended in a 75 L Henschel Vertical Mixer under a specific power level of around 96 W/lb and delivering a total specific energy of 6.4 Wh/lb. The power and energy levels were set with the impeller speed and blend time. The additive formulation selected based on the Surface Area Coverage (SAC) of the additives is as follows:

| Additive | SAC % |
|---|---|
| NA50HS (Silica) | 63% |
| SMT5103 (Titania) | 11% |
| H2050 (Silica) | 8% |

The formulation leads to a total Surface Area Coverage of the particle from the surface additives or around 82% and a Surface Area Coverage Ratio of NA50HS Silica to SMT5103 Titania of around 5.8. Calcium Stearate at 0.5% is also added as a lubricant.

Example 2

Properties of the Clear Toner Particles

Haze Measurements:

The haze of the clear toner particles prepared in Example 1 was compared against an Emulsion Aggregation clear toner (Control clear toner).

The Control clear toner was prepared by the Emulsion/Aggregation process for making chemical toners. In the Emulsion/Aggregation process particles are formed by aggregating particles in the range of 100 nm to 500 nm that are loaded into a reactor in the form of an aqueous dispersion. The particles are maintained in dispersion through the help of dispersion stabilizers such as, but not limited to, alkyldiphenyloxide disolfunate and sodium dodecylbenzene sulfonate. The aggregation of the particles is enabled by the addition of a suitable inorganic metal salt polymer such as polyaluminum chloride, polyaluminum sulfate, or calcium polysulfide. The addition of the inorganic metal salt polymer, controlled heat input, and shear induced by the rotation of an impeller in the reactor enables the growth of toner particles at a controlled rate. In general, the clear toner particles are formed by 1) loading the polyester resin dispersion, the release agent dispersion, and deionized water in a reactor, 2) mixing the dispersions in the reactor, 3) adding the inorganic metal salt polymer and homogenizing the mixture until the particles reach a median size of less than 1.0 micron, 4) raising the temperature of the contents in the reactor with controlled mixing until the particles reach the desired size, 5) addition of more polyester resin dispersion to form a resin shell around the particles in dispersion, 6) freezing particle growth by the addition of a base such as Sodium Hydroxide, 7) heating the particles above the glass transition temperature for the particles to coalesce and achieve the desired shape, and 8) cooling the particles below the glass transition temperature. After the particle formation is completed, the particle slurry is sieved to remove oversize particles. The particles are then washed with clean water to remove any excess ionic species on the particle surface and then dried. The dry particles are then blended with surface additives in the same manner as conventional or pulverized toner particles would.

The results are summarized in Table 1 below:

TABLE 1

| Toner | Measured Haze |
|---|---|
| Control clear toner | 25% |
| Example 1A - Clear parent particle without surface additives | 4.8% |
| Example 1B - Clear parent particle with surface additives | 6.2% |

Triboelectric Charge:

The J-zone tribo of the clear toner was determined and compared against that of a cyan and a black toners used in a Xerox iGen™ 150 digital press: such as, iGen 150/iGen4 Diamond Edition/iGen4 EXP Cyan Matte Dry Ink and iGen 150/iGen4 Diamond Edition/iGen4 EXP Black Matte Dry Ink.

A 60 minute paint shake time track in J-zone was completed for the Example 1B clear toner, cyan, and black toners, and the results are shown in FIG. 1. J-zone is a term used to indicate the type of environment when the relative humidity is around 10% and the temperature is around 70 degrees Celsius. The paint shake time track was generated by putting a predetermined amount of toner and carrier in a jar, putting the jar with the toner and carrier in a paint shaker, and measuring the triboelectric charge if the toner against the carrier at different points in time over a 60 minute period. There resulted no charge degradation over time and excellent charge stability for the clear toner compared to the color toners. No significant difference in J-zone tribo was also observed compared to the color toners.

Example 3

Machine Performance

The clear toner from Example 1B was tested in an digital press with five development stations to enable development of a clear toner layer on top of other toner layers with different colors on a substrate in two pass mode. In this mode, the colors (CMYK) were first deposited down/printed on a surface of a piece of paper, and then the paper was placed back into the feeder and sent through the xerographic printing machine again to deposit/print a clear layer on top of the printed colors. Hence, the gamut changes are primarily due to the transmission/absorption properties of the clear toner. The clear toner was tested with several colors at various clear mass target per unit area (TMA), 0.4 and 0.3 mg/cm$^2$. This enables minimal gamut loss due to image-on-image (IOI) effects. The 0.3 mg/cm$^2$ mass target showed the best results based on ΔE calculated between an area with clear and an area without clear for a specific color:

TABLE 2

| Gamut loss due to clear coat | |
|---|---|
| Color | ΔE (Color + Clear) |
| Magenta | 2.4 |
| Yellow | 3.7 |
| Cyan | 1.1 |
| Black | 3.0 |
| Red | 3.6 |
| Green | 3.0 |

Delta E (ΔE) is a unit of measure that calculates and quantifies the difference between two colors, one a reference toner and the other sample a color that attempts to match it. In general, a ΔE value of 2 or less is barely perceived by the human eye. A ΔE value between 3 and 5 indicates a humanly visually perceived color difference, but considered an acceptable match in commercial reproduction on printing presses. When compared to a standard, lower ΔE values indicate a better match or better color reproduction. Delta E can be calculated by different formulae; the values reported herein were calculated by the ΔE2000 formula, comparing the L*, a*, and b* values obtained by an X-RITE 939 color spectrophotometer. The L* (lightness), a* (yellow/blue color space), and b* (green/red color space) were calculated for each sample.

Figure 2:
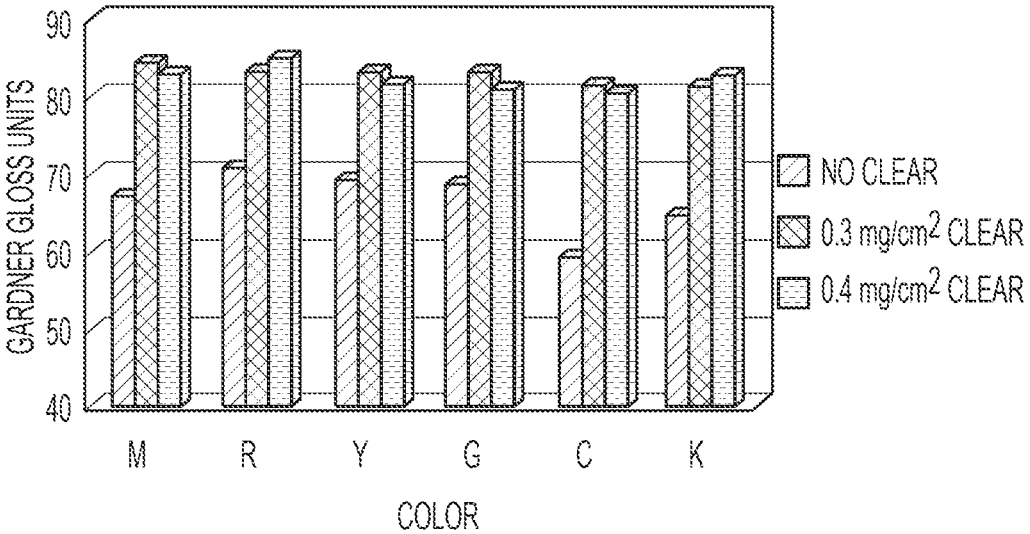
FIG. 2 is a chart showing gloss measurements for primary colors: Magenta, Yellow, Cyan, Black, Red and Green, with two different total mass per unit area (TMA) levels of clear toner according to an embodiment of the present disclosure.

The results show that although the gamut loss for most colors is at or slightly above the detection limit of the human eye (ΔE≥3), it is very close to the threshold, and within what would be considered acceptable. From a gloss perspective, the gain in gloss is in the order 15 to 20 units and does not increase significantly if the clear mass is increased above 0.3 mg/cm$^2$. The results are shown in FIG. 2.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

All the patents and applications referred to herein are hereby specifically, and totally incorporated herein by reference in their entirety in the instant specification.

What is claimed is:

1. A clear toner composition comprising:

a toner particle comprising:

a polyester resin;

a highly crosslinked polyester having a degree of crosslinking of from 19% to 49%;

a surface additive applied to a surface of the toner particle;

wherein the toner has a % haze of from about 1% to about 15%.

2. The clear toner of claim 1, wherein the toner is not an emulsion aggregation toner.

3. The clear toner of claim 1, wherein the toner is substantially free of added colorants.

4. The clear toner of claim 1, wherein the toner exhibits an Elastic Modulus of from about 1680 dyn/cm$^2$ to about 2520 dyn/cm$^2$.

5. The clear toner of claim 1, wherein the toner exhibits a Viscous Modulus of from about 250 dyn/cm$^2$ to about 385 dyn/cm$^2$.

6. The clear toner of claim 1, wherein the polyester resin comprises an amorphous polyester resin.

7. The clear toner of claim 6, wherein the amorphous polyester resin is selected from the group consisting of propoxylated bisphenol A fumarate resin, poly(propoxylated bisphenol co-fumarate), poly(ethoxylated bisphenol co-fumarate), poly(butyloxylated bisphenol co-fumarate), poly (co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), a copoly (propoxylated bisphenol A co-fumarate)-copoly(propoxylated bisphenol A co-terephthalate), a terpoly (propoxylated bisphenol A co-fumarate)-terpoly(propoxylated bisphenol A co-terephthalate)-terpoly-(propoxylated bisphenol A co-dodecylsuccinate), and combinations thereof.

8. The clear toner of claim 7, wherein the amorphous polyester resin comprises propoxylated bisphenol A fumarate resin.

9. The clear toner of claim 1, wherein the highly crosslinked resin prepared from an unsaturated poly(propoxylated bisphenol A co-fumarate) polyester resin.

10. The clear toner of claim 1, wherein the weight ratio of the polyester resin to the highly crosslinked resin is from about 80:20 to about 90:10.

11. The clear toner of claim 1, wherein the surface additive comprises silica, titania, and a stearate.

12. The clear toner of claim 11, wherein the silica comprises a negative charging silica.

13. The clear toner of claim 12, wherein the silica further comprises a positive charging silica.

14. The clear toner of claim 11, wherein the titania comprises titanium dioxide.

15. The clear toner of claim 1, wherein the toner particle having a mean size of from about 6 to about 8.

16. The clear toner of claim 1, wherein the toner has a gloss value of from about 70 to about 90 ggu.

17. A clear toner composition comprising:

a toner particle comprising:

a polyester resin;

a highly crosslinked polyester having a degree of crosslinking of from 19% to 49%, wherein the weight ratio of the polyester resin to the highly crosslinked polyester is from about 90:10 to about 80:20;

a surface additive applied to a surface of the toner particle, wherein the surface additive comprises a negative charging silica, a positive charging silica and a metal oxide;

further wherein the toner has a % haze of from about 1% to about 15%.

18. The clear toner of claim 17, wherein the toner exhibits an Elastic Modulus of from about 1680 dyn/cm$^2$ to about 2520 dyn/cm$^2$, and a Viscous Modulus of from about 250 dyn/cm$^2$ to about 385 dyn/cm$^2$.

19. The clear toner of claim 1, wherein the toner particle having a mean size of from about 6.0 to about 8.0.

20. A clear toner composition comprising:

a toner particle comprising:

a polyester resin;

a highly crosslinked polyester having a degree of crosslinking from 19% to 49%, wherein the weight ratio of the polyester resin to the highly crosslinked polyester is from about 90:10 to about 80:20;

a surface additive applied to a surface of the toner particle, wherein the surface additive comprises a negative charging silica, a positive charging silica and titanium dioxide;

wherein the toner has a % haze of from about 1% to about 15%, further wherein the toner exhibits an Elastic Modulus of from about 1680 dyn/cm$^2$ to about 2300 dyn/cm$^2$, and a Viscous Modulus of from about 250 dyn/cm$^2$ to about 385 dyn/cm$^2$.

* * * * *